United States Patent [19]

Butterwick

[11] 4,426,596

[45] Jan. 17, 1984

[54] PHOTOMULTIPLIER TUBE HAVING A HEAT SHIELD WITH ALKALI VAPOR SOURCE ATTACHED THERETO

[75] Inventor: Gilbert N. Butterwick, Leola, Pa.

[73] Assignee: RCA Corporation, New York, N.Y.

[21] Appl. No.: 237,845

[22] Filed: Feb. 24, 1981

[51] Int. Cl.[3] ..... H01J 40/00

[52] U.S. Cl. ..... 313/534; 313/105 R

[58] Field of Search ..... 313/95, 105 R, 33, 43, 313/47, 626, 533, 534

[56] References Cited

U.S. PATENT DOCUMENTS

| | | | |
|---|---|---|---|
| 1,943,984 | 1/1934 | Nakken | 313/103 R |
| 2,200,722 | 5/1940 | Pierce et al. | 313/105 |
| 2,404,803 | 7/1946 | Stafford | 313/94 |
| 2,414,099 | 1/1947 | Glass et al. | 313/94 |
| 2,880,344 | 3/1959 | Stoudenheimer | 313/102 |
| 2,952,499 | 9/1960 | Carson | 313/95 |
| 3,753,023 | 8/1973 | Sommer | 313/103 R |
| 3,858,955 | 1/1975 | Sommer | 316/19 |
| 3,884,539 | 5/1975 | Sommer | 316/6 |

OTHER PUBLICATIONS

Butterwick, "Oil Exploration with Photomultiplier Tubes," RCA Technical Communications/Copyright 1979/printed in USA'; pp. 62–65.

*Primary Examiner*—David K. Moore
*Assistant Examiner*—Robert E. Wise
*Attorney, Agent, or Firm*—Eugene M. Whitacre; Dennis H. Irlbeck; Vincent J. Coughlin, Jr.

[57] ABSTRACT

An improved photomultiplier tube of the type having a longitudinally-extending tube axis includes an evacuated envelope having a generally cylindrical wall member. The wall member is closed at one end by a faceplate and at the other end by a stem, heat sealed to the wall member. At least one source of alkali vapor is within the envelope. A photoemissive cathode is formed on the faceplate. A dynode cage assembly is spaced from the cathode in proximity to the stem. A plurality of stem leads extend through the stem for energizing the cathode, the dynode cage assembly and the source of alkali vapor. A heat shield is disposed transversely across the tube axis between the dynode cage assembly and the stem. The heat shield isolates the dynode cage assembly from the deleterious effect of the heat generated during the sealing of the stem to the wall member. The heat shield comprises a substantially inert, insulative material. The source of alkali vapor is mounted on the heat shield facing the dynode cage assembly. The heat shield also shields the vapor source from the heat generated during the sealing of the stem to the wall member.

8 Claims, 4 Drawing Figures

PHOTOMULTIPLIER TUBE HAVING A HEAT SHIELD WITH ALKALI VAPOR SOURCE ATTACHED THERETO

BACKGROUND OF THE INVENTION

The invention relates to a photomultiplier tube heat sealed within an envelope, and particularly to a structure for shielding the dynodes of the cage assembly of such a tube from the deleterious effects of the heat generated during the sealing operation. The shielding structure also provides means for mounting at least one alkali vapor source within the envelope so that the alkali vapor source is also shielded from the heat generated during the sealing operation.

A photomultiplier tube for an application such as, for example, oil-well logging, is preferably small and rugged, since the tube must operate reliably in an environment where it is subjected to shock, vibration and high operating temperatures. Such a tube is described in my U.S. Pat. No. 4,355,258, filed Dec. 16, 1980, entitled, "PHOTOMULTIPLIER TUBE HAVING A STRESS ISOLATION CAGE ASSEMBLY," incorporated herein for disclosure purposes. The RCA C33016G photomultiplier tube, shown in FIG. 1 of the copending application, comprises a glass envelope having a diameter of 25.4 mm and a length of about 60 mm. As disclosed in the above-identified application, the deleterious effects of shock and vibration can be minimized by using a stem having a plurality of stiff, short support leads connected directly to a plurality of stress isolation eyelets attached to the dynode cage assembly. Flexible nickel wires extend from the stress isolation eyelets to the anode and the dynodes. Unfortunately, in a small photomultiplier tube, such as the C33016G, in which the dynode cage assembly is mounted in proximity to the stem, the dynodes closest to the stem are frequently overheated and damaged when the stem is heat sealed to the envelope. The damage is irreversible and results in the loss of the tube. Properly designed sealing fixtures and the lowest possible sealing temperatures have reduced the number of tubes lost because of overheated dynodes; however, in the highly competitive photomultiplier tube business, it is desirable to further minimize tube losses by eliminating sealing-related dynode damage.

Even in tubes without apparent sealing-related dynode damage, the sealing heat can cause an adverse reaction with the alkali compounds used to form the photocathode and to activate the dynodes. Such tubes exhibit undesirable high temperature instability.

SUMMARY OF THE INVENTION

An improved photomultiplier tube of the type having a longitudinally-extended tube axis includes an evacuated envelope having a generally cylindrical wall member. The wall member is closed at one end by a faceplate and at the other end by a stem heat sealed to the wall member. At least one source of alkali vapor is within the envelope. A photoemissive cathode is formed on the faceplate. A dynode cage assembly is spaced from the cathode in proximity to the stem. Electrical connecting means extends through the stem for energizing the cathode, the dynode cage assembly and the source of alkali vapor. A heat shield is disposed transversely across the tube axis between the dynode cage assembly and the stem. The heat shield comprises a substantially inert, insulative material. The source of alkali vapor is mounted on the heat shield facing the dynode cage assembly.

DETAILED DESCRIPTION OF THE PREFERRED EMBODIMENT

Figure 1:
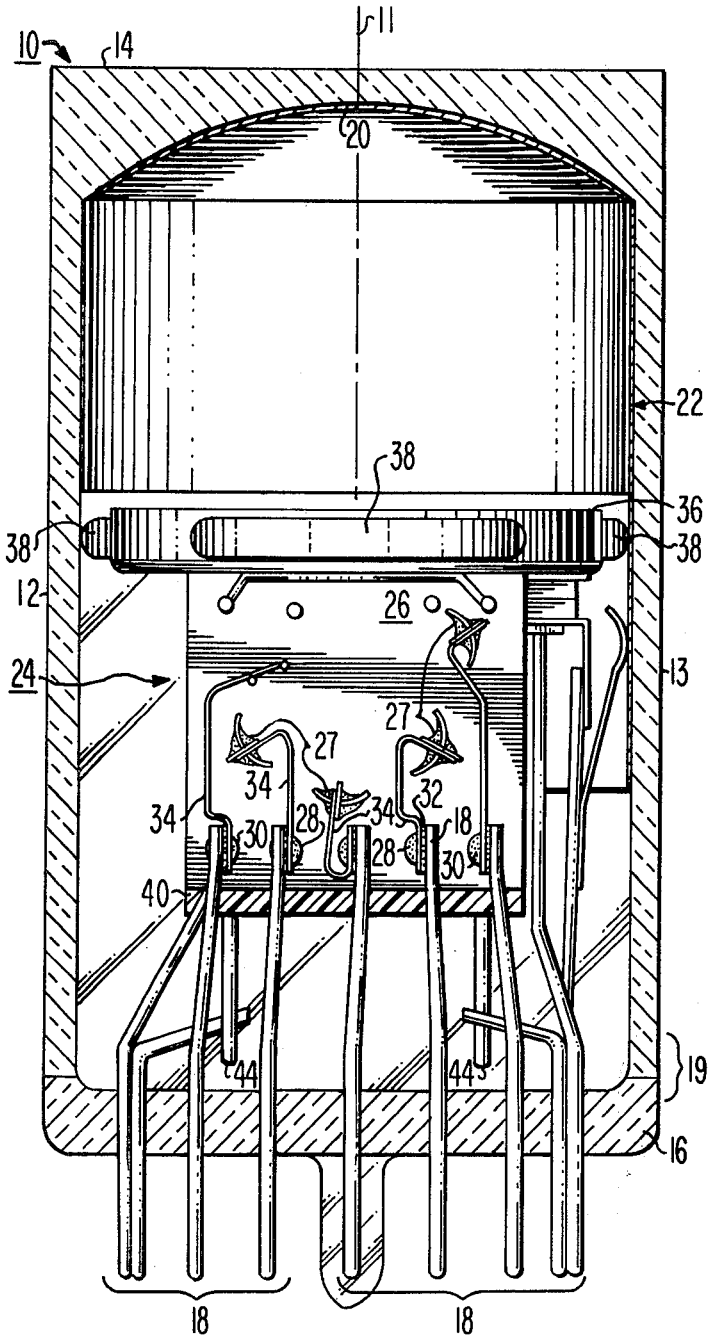
FIG. 1 is an enlarged plan view in axial section of a photomultiplier tube in which the present invention is incorporated.

Referring to the drawings, there is shown in FIG. 1 a photomultiplier tube 10 having a longitudinally-extending tube axis 11. The tube 10 comprises an evacuated envelope 12 having a generally cylindrical wall member 13, a transparent faceplate 14 and a stem 16, through which a plurality of relatively stiff stem leads 18 are vacuum sealed. The wall member 13, the faceplate 14 and the stem 16 comprise glass structures which are heat sealed together at elevated temperatures by glass sealing techniques well known in the art. Typically, wall member 13 with the faceplate 14 attached thereto is preheated to about 500° C. The stem 16 is simultaneously heated to a temperature of about 500° C. The preheated elements are sealed by a gas flame at a sealing temperature of about 1100° C. on rotary sealing equipment. The sealing area 19 is indicated in FIG. 1. Alternatively, the envelope may comprise a ceramic-metal structure having a sapphire faceplate. In this instance, the stem comprises a ceramic member having a metal sealing flange. The stem is sealed to the envelope by heliarc welding techniques well known to those having ordinary skill in the art. Such a structure is described in my U.S. Pat. No. 4,376,246, filed Jan. 22, 1981, entitled, "A SHIELDED FOCUSING ELECTRODE ASSEMBLY FOR A PHOTOMULTIPLIER TUBE."

A photoemissive cathode 20 is formed on an interior surface of the faceplate 14. The cathode 20 comprises an alkali-antimonide structure formed by vapor depositing at least one alkali metal on an antimony film previously evaporated onto the interior surface of the faceplate 14. An aluminum coating 22 is deposited on the upper inner surface of the envelope 12. The coating 22 makes electrical contact with the photoemissive cathode 20.

A dynode cage assembly, indicated generally as 24, is supported within the envelope 12 preferably by a pair of spaced substantially parallel ceramic dynode support spacers 26, only one of which is shown. The support spacers 26 extends substantially parallel to the longitudinal axis 11 of the tube. The dynode cage assembly 24 includes a plurality of closely-spaced dynodes 27 (the ends of some of which are shown) extending between the support spacers 26 and secured thereto. The dynodes 27 are arranged in a circular configuration well known in the art and shown, for example, in U.S. Pat. No. 2,818,520 to R. W. Engstrom et al., issued on Dec. 31, 1957 and incorporated herein for disclosure purposes. An anode (not shown) is enclosed within the last dynode of the cage assembly 24. The preferred embodiment is a ten-stage photomultiplier tube comprising ten beryllium-copper dynodes, having a beryllium-oxide secondary emissive surface, in addition to the anode. The dynode cage assembly 24 is spaced from the cathode 20 in proximity to the stem 16. Typically, the spacing between the cage assembly 24 and the stem is about 5 to 7 mm. The cage assembly 24 is mounted close to the stem 16 in order to reduce the deleterious effects of shock and vibration by minimizing the length of the internal projection of the stem leads 18. The short, relatively stiff leads 18 resist and quickly damp vibrations. The dynode cage assembly 24 is described in detail in my U.S. Pat. No. 4,355,258, filed Dec. 16, 1980, entitled "PHOTOMULTIPLIER TUBE HAVING A STRESS ISOLATION CAGE ASSEMBLY." The cage assembly 24 comprises a plurality of deformable stress isolation eyelets 28 disposed within the stress isolation apertures 30 of the dynode spacers 26. The eyelets are formed from hollow stainless steel tubing having a wall thickness of about 0.13 mm. One end of each of the eyelets 28 extends outwardly from the dynode support spacers 26. The outwardly extending end of each of the eyelets 28 is crimped to form end portions 32. The crimped end portions 32 are preferably oriented along the longitudinal axis of the tube to facilitate the attaching, for example, by welding, of one of the stem leads 18 to each of the crimped end positions 32. Interconnection between the crimped end portions 32 and the dynodes and the anode is provided by thin, relatively flexible connecting leads 34.

A shield cup 36 having an aperture (not shown) is placed intermediate the photocathode 20 and the dynode cage assembly 24, and is attached to the cage assembly 24. A plurality of bulb spacers 38 are disposed circumferentially around the shield cup 36 to center the shield cup and the attached cage assembly 24. Within the shield cup 36 is an antimony source (not shown) which is used in conjunction with at least one alkali metal vapor source, described hereinafter, to form the photocathode 20. The alkali vapor source is also utilized to activate the dynodes 27.

Figure 2:
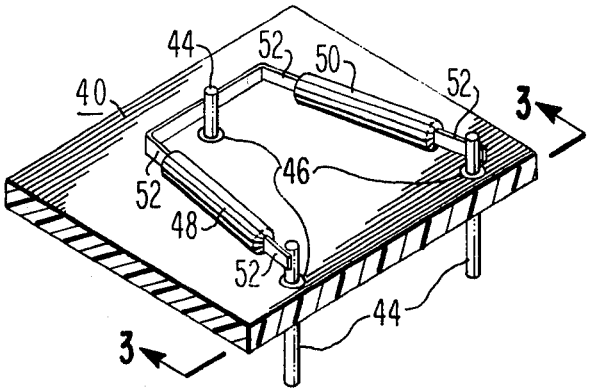
FIG. 2 is an enlarged perspective view of a heat shield with alkali channels attached to mounting leads extending through and attached to the heat shield.
Figure 3:
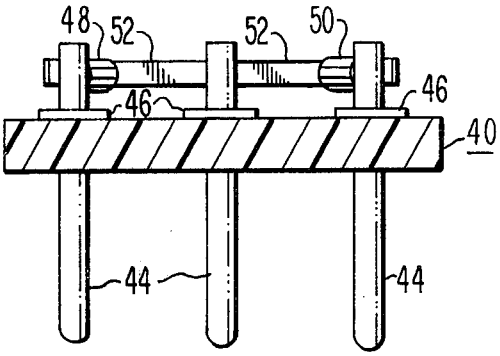
FIG. 3 is an enlarged plan view of the heat shield along lines 3—3 of FIG. 2.

The novel heat shield 40 shown in FIGS. 1–3 comprises a substantially inert, insulative material. A high alumina ceramic having an alumina content in excess of 95 percent is preferred. The heat shield 40 is disposed transversely to the tube axis 11 between the dynode cage assembly 24 and the stem 16. The heat shield 40 shields the plurality of dynodes 27 of the cage assembly 24, and especially the dynodes closest to the sealing area 19, from the deleterious effects of the heat generated during the sealing operation. Excessive heating of the dynodes 27 oxidizes the secondary emissive surface of the dynodes to such an extent that the secondary emission ratio, defined as the average number of secondary electrons emitted for primary electrons incident on the surface, is drastically reduced. In some extreme instances, the ratio is reduced to less than unity. The gain of photomultiplier tubes having heat-damaged dynodes is generally low and unstable, especially at elevated operating temperatures, making such tubes unacceptable for sale.

In addition to shielding the dynodes, it has been found that the heat shield 40 also provides a thermally-shielded support platform for mounting the alkali vapor sources used to form the cathode 20 and to activate the secondary emissive surfaces of the dynodes 27 of the cage assembly 24. A plurality of apertures (not shown) are formed through the body of the ceramic heat shield 40. The ceramic material surrounding the apertures is metallized according to a method described in U.S. Pat. No. 3,290,171, to Zollman et al., issued Dec. 6, 1966 and entitled, "METHOD AND MATERIAL FOR METALLIZING CERAMICS," and incorporated herein for reference purposes. The metallized portion of the ceramic is then nickel plated by a method well known in the art. A plurality of cylindrical metal alloy leads 44, manufactured under the trademark Kovar, extend through a different one of each of the apertures and are brazed to the heat shield 40 by means of a solder washer (not shown) disposed between a support washer 46 and the heat shield 40. The support washer 46 also comprises a metal alloy material such as that sold under the trademark Kovar. Only one support washer 46 is required to support each of the leads 44.

The alkali vapor sources, which in the preferred embodiment comprise a sodium vapor and a potassium vapor, are contained in channels 48 and 50, respectively. The channels 48 and 50 comprise a thin tubular tantalum retainer filled with an alkali chromate or dichromate, a reducing agent and a moderating agent. The ends of the channels 48 and 50 are crimped to form tabs 52 which are welded to the support leads 44. The support leads 44 thus provide electrical terminals to which the resistively-heated channels 48 and 50 are connected. The other end of the support leads 44 extend through the heat shield 40 and are welded to selected ones of the stem leads 18 which protrude inwardly through the stem 16. The greatest amount of heat shielding is provided when the heat shield 40 is in contact with the support spacers 26 of the dynode cage assembly 24 and extends substantially transversely across the support spacers 26. In the preferred embodiment, the heat shield 40 comprises a parallelepiped having a thickness ranging from about 0.51 to 1.27 mm and transverse dimensions of about $13.21 \pm 0.51$ mm$\times 13.21 \pm 0.51$ mm.

Recent tests of pulse height, pulse-height resolution and pulse-height ratio performed on eight C33016G photomultiplier tubes, three of which utilized the heat shield 40 and five of which did not have the heat shield, have shown that the high temperature operating stability of tubes having the heat shield 40 disposed between the dynode cage assembly 24 and the stem 16 was superior to tubes not having the heat shield.

TEST METHOD

Figure 4:
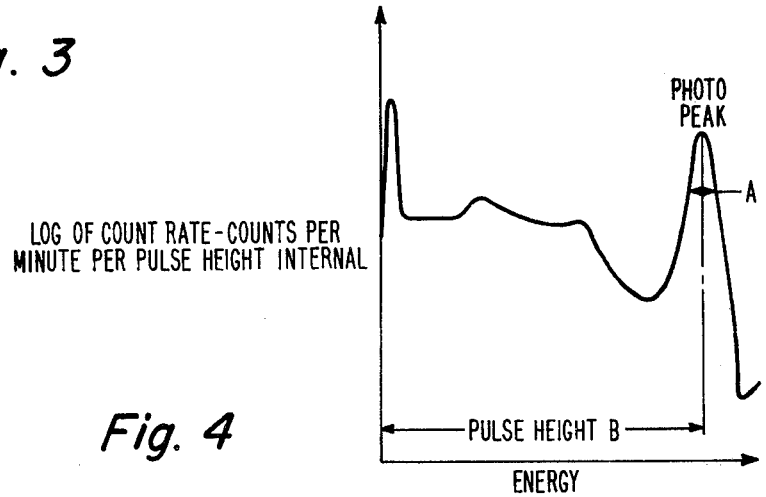
FIG. 4 is a graph of the typical pulse height distribution obtained with a thallium doped, sodium iodide crystal and cesium 137 source.

The parameters of pulse height and pulse-height resolution are measured by optically coupling the faceplate of the photomultiplier to a thallium doped, sodium iodide crystal scintillator. A cesium 137 source provides monoenergetic (662 keV) gamma rays which lose all of their energy by photoelectric conversion in the crystal. An operating voltage of about 1500 volts is applied to the photomultiplier tube by means of a voltage divider of a type well known in the art. The output of the photomultiplier tube is connected to and displayed on a multichannel analyzer. A typical pulse-height distribution from a cesium 137 source and a sodium iodide crystal is grphically shown in FIG. 4. A detailed description of scintillation counting may be found in *The RCA Photomultiplier Handbook* (PMT-62) pp. 69–72 (1980). In FIG. 4, the energy, i.e., the pulse height (PH), is plotted along the abscissa while the count rate is plotted along the ordinate. The photopeak of FIG. 4 is associated with and centered about 662 keV, the energy of the cesium 137 gamma rays.

It is known that pulse height is dependent on temperature and relatively independent of tube geometry and gain. As the temperature increases, the magnitude of the output pulse decreases because of a decrease in photocathode sensitivity and crystal scintillation efficiency. At the same time, thermionic emission from the photocathode increases until, at a temperature near 200° C., the desired signal is lost in the background thermal noise.

Pulse-height resolution (PHR) in percent, is defined as 100 times the ratio of the width of the photopeak at half the maximum count rate in the photopeak height (A), to the pulse height at maximum photopeak count rate (B) as shown in FIG. 4. Pulse-height resolution generally increases with increasing temperature since pulse-height resolution is inversely proportional to pulse height. The smaller the value of the pulse-height resolution, the better the tube can resolve the photopeak height.

Pulse-height ratio (PHRatio), in percent, is defined as 100 times the ratio of the pulse height at an elevated temperature divided by the room temperature pulse height. Each of the tubes was cycled from room temperature (20° C.) to an elevated temperature of 150° C. The tubes were held at 150° C. for eight hours and then cooled to room temperature. Four test cycles were completed for each of the tubes. It is believed that the pulse-height ratio, in percent (PHRatio), is the major indicator of superior tube performance. The higher the pulse-height ratio, in percent, throughout the test cycle and at the end of the fourth cycle, the more stable the tube.

For simplicity, only the initial pulse height ratio comparing the pulse height at 150° C. during the first temperature cycle to the original pulse height at room temperature, and the final pulse-height ratio comparing the pulse height at 150° C. during the third cycle to the final room temperature pulse height during cycle four, are recorded in the following Table.

TABLE

| Ser. No. | Shield | Initial PH Ratio, % | Final PH Ratio, % |
|---|---|---|---|
| 30516 | yes | 73 | 58 |
| 30517 | yes | 82 | 68 |
| 30518 | yes | 76 | 61 |
| 31590 | no | 51.4 | 45.9 |
| 31591 | no | 44 | 38 |
| 31592 | no | 55.3 | 51 |
| 31593 | no | 51.4 | 43 |
| 31594 | no | 51.7 | 46 |

The three tubes having the heat shield 40 disposed between the dynode cage assembly 24 and the stem 16 had significantly higher initial and final pulse-height ratios than did the five tubes fabricated without the heat shield. It is believed that the heat shield 40 thermally shields the alkali channels 48 and 50 during the stem sealing operation and thus prevents an adverse reaction which apparently occurs to the compounds within the channels. Support for the belief that some unknown, but adverse reaction occurs is provided by the fact that higher evaporation currents are required to obtain alkali vapors from tubes not having the heat shield 40. The heat shield 40 in addition to shielding the dynodes 27 also contribute to forming more stable high temperature photocathodes which exhibit substantially higher pulse-height ratios than similar tubes without the heat shield 40.

What is claimed is:

1. In a photomultiplier tube having a longitudinally-extending tube axis, said tube comprising an evacuated envelope including a generally cylindrical wall member, said wall member being closed at one end by a faceplate and at the other end by a stem, said stem being heat sealed to said wall member, at least one source of alkali vapor within said envelope, a photoemissive cathode formed by said alkali vapor on said faceplate, a dynode cage assembly spaced from said cathode in proximity to said stem, and electrical connecting means extending through said stem for energizing said cathode, said dynode cage assembly and said source of alkali vapor, the improvement comprising:

a heat shield disposed transversely to said tube axis between said dynode cage assembly and said stem, said heat shield comprising a substantially inert, insulative material, said source of alkali vapor being mounted on said heat shield facing said dynode cage assembly, said heat shield protecting said dynode cage assembly and said source of alkali vapor from the deleterious effects of heat generated during the heat sealing of said stem to said wall member.

2. The tube as in claim 1, wherein said dynode cage assembly includes;

a pair of dynode support spacers extending substantially parallel to said tube axis, a plurality of dynodes, each of said dynodes having a secondary emissive surface, said dynodes extending between said pair of support spacers and secured thereto, and an anode adjacent to the last dynode of said plurality of dynodes.

3. The tube as in claim 2, wherein said heat shield extends substantially transversely across said support spacers of said dynode cage assembly.

4. The tube as in claim 3, wherein said heat shield contacts said support spacers of said dynode cage assembly.

5. The tube as in claim 1, wherein said heat shield includes a plurality of conductive support leads extending through a like plurality of apertures formed in said heat shield, said leads being bonded to said heat shield.

6. The tube as in claim 5, wherein said support leads provide electrical terminals for said source of alkali vapor.

7. The tube as in claim 6, wherein said heat shield comprises a high alumina ceramic material and said conductive support leads comprise Kovar rods brazed to said heat shield.

8. The tube as in claim 6, wherein said source of alkali vapor comprises at least one resistively-heated channel.

* * * * *